United States Patent [19]

Oxenberg

[11] 4,045,888

[45] Sept. 6, 1977

[54] ATHLETIC SHOE

[76] Inventor: Bruce Oxenberg, 6233 Trotter St., Philadelphia, Pa. 19111

[21] Appl. No.: 735,873

[22] Filed: Oct. 26, 1976

[51] Int. Cl.[2] ..... A43B 5/00; A43B 13/04

[52] U.S. Cl. ..... 36/114; 36/32 R

[58] Field of Search ..... 36/32 R, 59 R, 59 A, 36/59 C, 114, 83

[56] References Cited

U.S. PATENT DOCUMENTS

| | | | |
|---|---|---|---|
| 3,061,952 | 11/1962 | Prohaska | 36/59 C |
| 3,316,662 | 5/1967 | Schmadeke | 36/32 R |
| 3,555,706 | 1/1971 | Edmonds | 36/114 |
| 3,593,436 | 7/1971 | Vietas | 36/32 R |

*Primary Examiner*—Patrick D. Lawson

*Attorney, Agent, or Firm*—Michael F. Petock

[57] ABSTRACT

A canvas-type athletic shoe, particularly adapted for playing street hockey. The shoe is provided with a plurality of triangularly shaped gripping members, each having a principal sloping face depending outwardly from the bottom of the shoe. The principal sloping face of each triangularly shaped gripping member may be either the hypotenuse of a right-angled triangle, the longest side of an obtuse triangle, either equal side of an isosceles triangle, or, the longer of the two sides of a scalene triangle which are not adjacent to the bottom of the shoe. Each triangularly shaped gripping member is said to point in the direction of the acute angle each principal sloping face makes with the bottom of the shoe. Where the inside halves of the bottoms of the shoes are defined as those halves which are adjacent when the wearer stands with his feet together, toes pointed forward, a set of triangularly shaped gripping members is longitudinally disposed on the inside half of the bottom of the shoe, pointing toward the center of the shoe. Two sets of triangularly shaped gripping members are transversely disposed on the outside half of the shoe. Those triangularly shaped gripping members on the sole portion of the outside half of the bottom of the shoe point toward the rear of the shoe and those triangularly shaped gripping members on the heel portion of the outside half of the bottom of the shoe point toward the front of the shoe. Rectangular, longitudinal dividing members run substantially the length of the center of the bottom of the shoe, separating the inside and outside halves thereof. In addition, sets of triangularly shaped gripping members are transversely disposed at the extreme front and the extreme rear of the bottom of the shoe, with both sets of triangularly shaped gripping members pointed inwardly toward the center of the shoe. The shoe extends well above the ankle, with foam padding provided therein to protect the ankle area and the back of the leg. Additional padding is located under the tongue of the shoe so that the ankle is completely encircled. A reinforced section is provided over the toe area.

21 Claims, 9 Drawing Figures

ATHLETIC SHOE

BACKGROUND OF THE INVENTION

Athletic shoes used in most contact sports must serve two distinct, but equally important functions. The first such function is to provide superior traction, permitting the user to start, run, change directions, and stop with equal ease. The second such function is to protect the weakest parts of a user's foot, the ankle in particular, form injuries due to impacting balls, pucks, other game apparatus and other players.

The subject invention provides superior traction characteristics by disposing transverse and longitudinal triangularly shaped gripping members about the bottom of the shoe, in four distinct areas thereon, such that transverse ribs in the front of the shoe point towards the rear, transverse ribs in the rear portion of the shoe point towards the front and transverse ribs on the inside half of the shoe point towards the center of the shoe.

Oppositely directed, transverse wedge or triangularly shaped ribs have been used in the past for improving traction. In U.S. Pat. No. 3,507,059—Vietas, a shoe is disclosed having wedge-shaped transverse elements in which the wedge-shaped elements on a portion of the sole point towards the rear of the shoe, and wedge-shaped elements on a portion of the heel point towards the front of the shoe. Vietas also discloses the use of longitudinal cut-out sections in the transverse wedges. The arrangement in Vietas of the wedge-shaped members is four alternating sections, as contrasted to the subject invention which has all transverse ribs in the sole section pointed to the rear and all transverse ribs in the heel of the shoe pointed towards the front. The extreme toe and heel areas of the Vietas patent do not have any wedge-shaped gripping members, while the subject invention places ribs particularly in these two areas. Vietas also shows no longitudinal wedge-shaped members, relying on the elements of an artificial turf to engage a series of slots through the transverse wedges on his shoe. The present invention is effective both on hard pavement and on artificial turf.

Schmadeke—U.S. Pat. No. 3,316,662 discloses half transverse triangularly shaped members and half longitudinal triangularly shaped members. In Schmadeke, however, the transverse members are located on the inside half of the shoe and the longitudinal members are located on the outside half of the shoe. When a person is running forward and wishes to turn, for instance, to the left, the person will plant his righ foot, leaning particularly on the inside half thereof. Once the right foot is so planted, a quick move to the left is possible. In the Schmadeke configuration, forcefully planting the inside half of the foot will result in that foot slipping to the side since the longitudinal grippers will not be engaged with the ground. The present invention, in recognition of the fact that turning quickly relies on planting the inside of the foot places longitudinal members on the inside of the shoe. The transverse members in Schmadeke also all point towards the rear of the shoe, offering no members pointed towards the front, which would aid the wearer in stopping.

With regard to the second problem, providing impact protection for vulnerable parts of the foot, neither Vietas nor Schmadeke even suggest such protection.

Such protection is found, however, in ice hockey skates and ski boots. For example, Planert—U.S. Pat. No. 2,789,374 discloses an ice hockey skate shoe in which padding is provided for the ankle and the back of the leg. A tendon guard is disclosed which is attachable to an ice hockey shoe. However, the tendon guard is not located inside of the shoe and does not form a part thereof. In the present invention, foam padding is provided integrally with the shoe including sections around the ankle and up the back of the shoe, as well as under the tongue of the shoe.

Canfield—U.S. Pat. No. 3,529,386 discloses a pad for a ski boot and a means of retaining it in position. Padding in a ski boot serves a different function than to protect the user against impacts. The purpose of such padding, often molded to fit the foot of each user, prevents the foot from slipping around the inside of the boot. Form-fitted ski boots are quite expensive.

None of the foregoing patents nor any combination thereof disclose the unique tread design of the present invention and none of these references show the use of padding in a canvas-type shoe. It can be seen then, that not only does the present invention fulfill the needs of providing a shoe with superior traction characteristics and protection from impact upon vulnerable areas of the foot, but provides them in an inexpensive canvas-type shoe.

BRIEF SUMMARY OF THE INVENTION

It is an advantage of this invention to provide an athletic shoe with improved traction characteristics, for movement in all directions, as well as quick starting and stopping.

It is another advantage of this invention to provide an athletic shoe with protective padding in areas around the ankle and the back of the foot and reinforced construction in the toe area.

It is a further advantage of this invention to provide an athletic shoe with protective padding in the areas around the ankle and back of the foot, with reinforced construction of the toe area and improved traction characteristics, in an inexpensive canvas-type shoe.

It is a still further advantage of this invention to provide an inexpensive athletic shoe which is particularly adapted for use in the game of street hockey.

In brief, the subject invention is a canvas-type shoe, commonly called a sneaker, which is particularly adapted for playing street hockey. The bottom of the sneaker is provided with a plurality of triangularly shaped gripping members each having a principal sloping face depending outwardly from the bottom of the shoe. The principal sloping face of each triangularly shaped gripping member may be the hypotenuse of a right-angled triangle, the longest side of an obtuse triangle, either equal side of an isosceles triangle, or, the longer of the two sides of a scalene triangle which are not adjacent to the bottom of the shoe. Each triangularly shaped gripping member is said to point in the direction of the acute angle each principal sloping face makes with the bottom of the shoe. Where the inside halves of the bottoms of the shoes are defined as those halves which are adjacent when the wearer stands with his feet together, toes pointed forward, a set of triangularly shaped gripping members is longitudinally disposed on the inside half of the bottom of the shoe, pointing toward the center of the shoe. Two sets of triangularly shaped gripping members are transversely disposed on the outside half of the bottom of the shoe. Those triangularly shaped gripping members on the sole portion of the outside half of the bottom of the shoe point toward the rear of the shoe and those triangularly shaped gripping members on the heel portion of the outside half of the bottom of the shoe point toward the front of the shoe.

Two rectangular, longitudinal dividing members run substantially the length of the center of the bottom of the shoe, separating the longitudinally disposed triangularly shaped gripping members on the inside half from the transversely disposed triangularly shaped gripping members on the outside half thereof. In addition, the extreme front and the extreme rear of the bottom of the shoe contain transversely disposed triangularly shaped gripping members, pointing inwardly toward the center of the shoe. The upper of the shoe is high, extending well above the ankle. Foam padding is provided inside the shoe to protect the ankle area and the back of the foot. Additional padding is located inside the tongue of the shoe so that the ankle is completely encircled. As additional protection, a reinforced section is provided over the toe area of the shoe.

BRIEF DESCRIPTION OF THE DRAWINGS

For the purpose of illustrating the invention, there are shown in the drawings forms which are presently preferred; it being understood, however, that this invention is not limited to the precise arrangements and instrumentalities shown.

DETAILED DESCRIPTION OF THE PREFERRED EMBODIMENT

Figure 1:
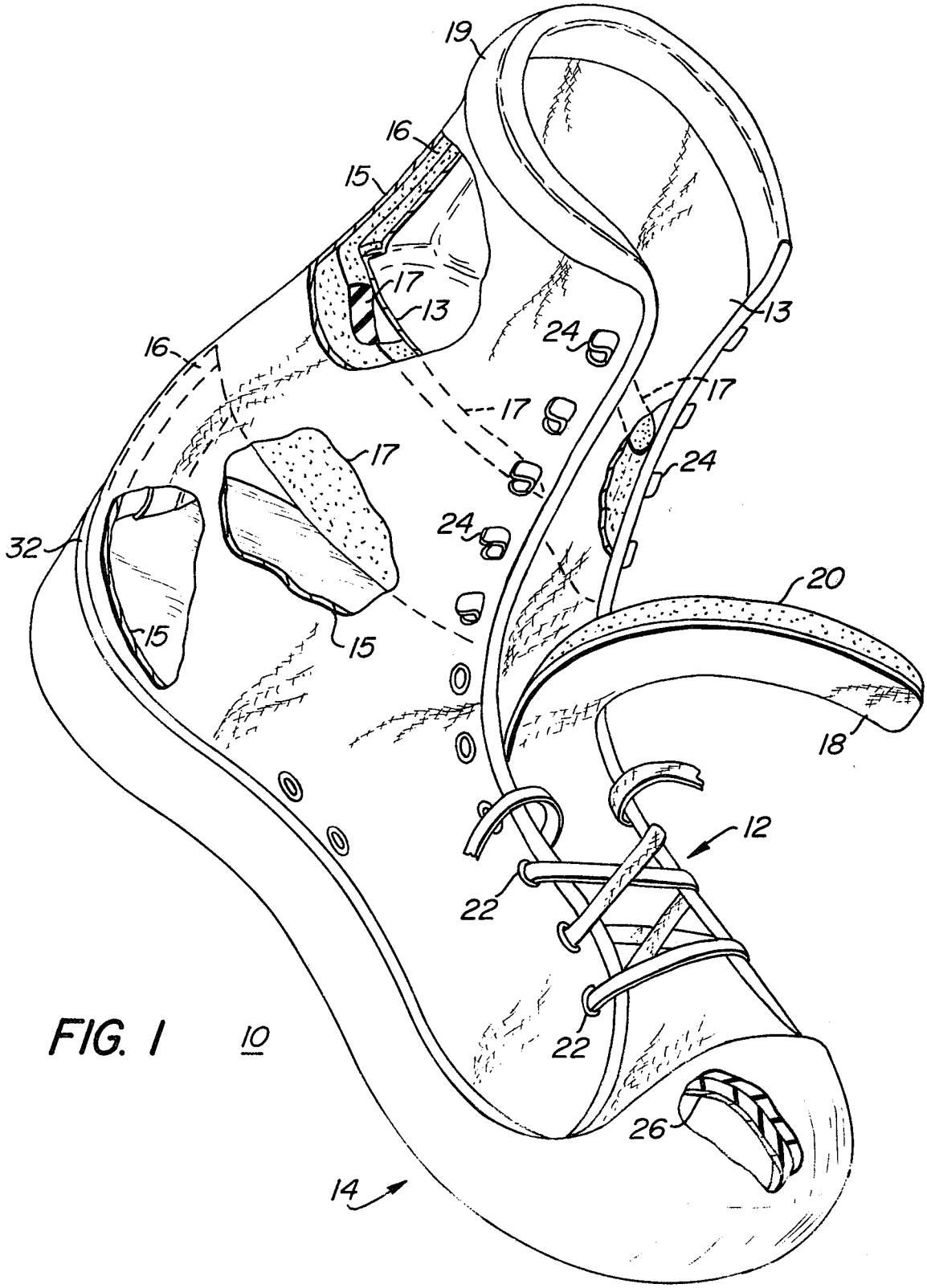
FIG. 1 is a top perspective view of a left shoe in accordance with the present invention, partially broken away.

With reference to FIG. 1, the present invention is an athletic shoe 10 with a suitably strong and flexible fabric upper 12 and a resilient, rubber-like lower 14. The upper 12, by way of example and not intended to be limiting, is approximately eight inches high. The upper 12 is comprised of an outer layer 15 and a softer, inner liner 13. The outer layer 15 may be canvas and the inner liner 13 may be a softer cotton or synthetic blend of fabric. The lower 14 may be cured natural or synthetic rubber, a polyurethane elastomer or other similar suitable material. The sole portion 28 and the heel portion 30 of the bottom of the lower 14 are substantially flat.

Padding is attached between the inner liner 13 and the outer layer 15 at the rear of the upper 12, in a rectangular strip 16 running from the bottom of the upper 12 to the top thereof, and by a circular portion 17 surrounding the ankle area. Additional tongue padding 20 is mounted on the inside of the tongue 18 of the upper 12, completing the circle of padding around the ankle. The rectangular padding strip 16 may be approximately ¼ inch thick. The circular padded portion 17 is preferably, but not necessarily, the same thickness as the rectangular padding strip 16 where the circular padded portion 17 and the rectangular padding strip are joined. The circular padded portion 17, however, may be increased to a thickness of approximately ½ inch as it encircles the ankle from both sides. The additional tongue padding 20 may be approximately ¼ inch thick. The top of the upper 12 has another strip of calf padding 19 attached thereto, to prevent chafing of the wearer's leg by the top of the upper 12. The dimensions of padding 16, 17 and 19 are given by way of example of a presently preferred embodiment. These dimensions are not intended to be limiting and it will be obvious to those skilled in the art that these dimensions may be varied. The padding 16, 17 and 19 may be foam rubber, flexible polyurethane foam or other suitable, flexible, impact-absorbent material.

The upper 12 also has a reinforced toe section 26, which may be made from the same material as the lower 14.

A combination of eyelets 22 and hooks 24 is provided for conveniently lacing the shoe 10 onto the user's foot.

Figure 2:
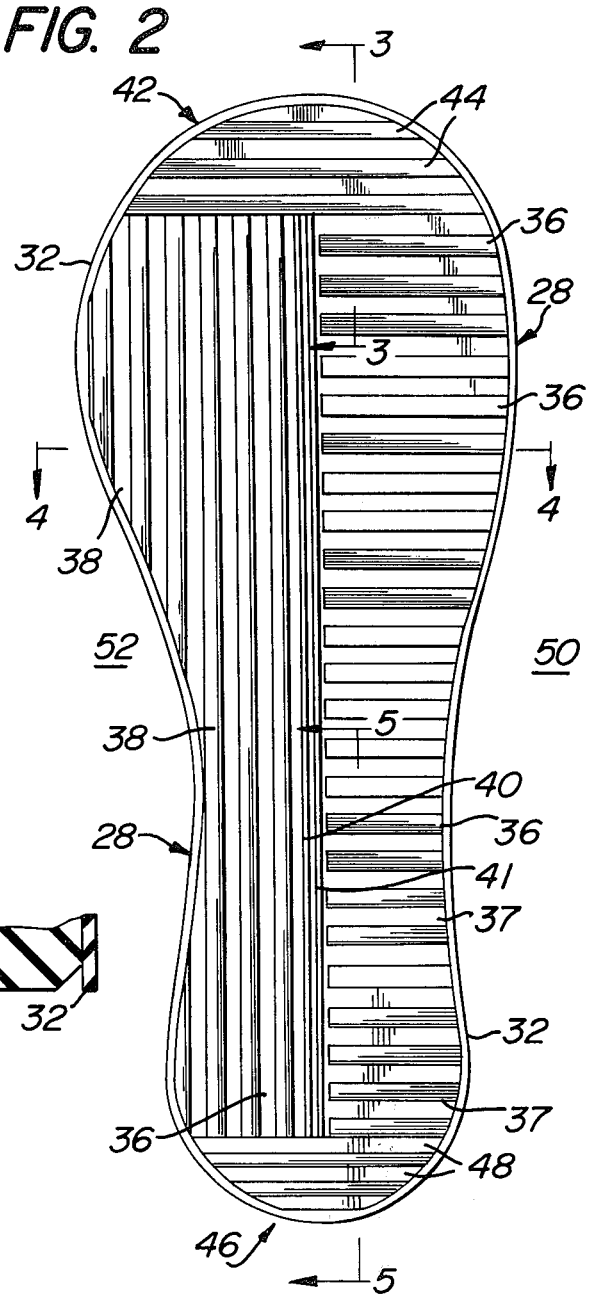
FIG. 2 is a plan view of the tread design on the bottom of a left shoe in accordance with the present invention.

The bottom of the lower 14, as shown in FIG. 2, has a heel portion 30 and a sole portion 28, which are substantially flat and which are surrounded by a reinforced outer rim 32, which may also be the same material as the rest of the lower 14.

With reference to FIG. 2, which depicts the tread design on the bottom of the lower 14 of the left shoe 10, there is defined for purposes of illustration an outside half 50 and an inside half 52 of the bottom of the lower 14. When the wearer stands with his feet together, toes pointed forward, the inside halves 52 of the shoes are adjacent to one another. By way of further illustration, the inside half 52 corresponds to that side of the shoe which supports the foot's arch and ball.

The shoe 10, on the bottom of the lower 14, is provided with a plurality of gripping members, sets 36, 37, 38, 44 and 48, each of these gripping members being triangularly shaped in cross-section. Each triangular shaped gripping member also has a principal sloping face 60 depending outwardly from the bottom of said lower 14. Further, each triangularly shaped gripping member, sets 36, 37, 38, 44 and 48, is said to point in the direction of the acute angle 62 which each principal sloping face 60 makes with the bottom of the lower 14. An acute angle is defined as any angle greater than 0° and less than 90°. Each set of triangularly shaped gripping members 36, 37, 38, 44 and 48 provides traction for movement in the direction opposite to which it points.

Figure 6A:
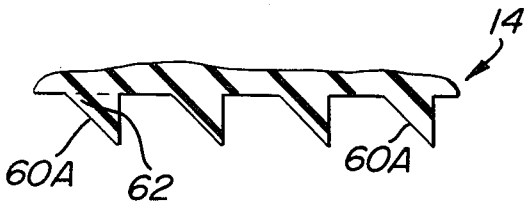
FIGS. 6A-6D show alternate embodiments of tread cross-sectional shapes in accordance with the present invention.

The principal sloping face 60 is determined by the particular type of triangular cross-section. When the triangular cross-section is that of a right-angled triangle, defined as a triangle having one 90° angle, the principal sloping face 60A is the hypotenuse of that right-angled triangle, as depicted in FIG. 6A.

Figure 6B:
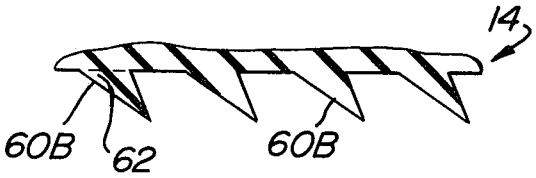

When the triangular cross-section is that of an obtuse triangle, defined as a triangle having one angle greater than 90°, the principal sloping face 60B is preferably, although not necessarily, the longest side of that obtuse triangle, as depicted in FIG. 6B.

Figure 6C:
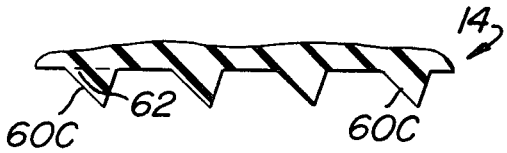

When the triangular cross-section is that of an isosceles triangle, defined as a triangle having two sides of equal length, the principal sloping face 60C may be either equal side of that isoceles triangle, as depicted in FIG. 6C.

Figure 6D:
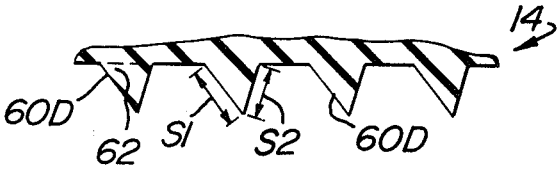

When the triangular cross-section is that of a scalene triangle, defined as a triangle having three sides of unequal lengths and having all angles less than 90°, the principal sloping face 60D is the longer of the two sides S1 and S2 (S1 > S2) of that scalene triangle which are not adjacent to the bottom of the lower 14, as depicted in FIG. 6D.

The triangularly shaped gripping members, sets 36, 37, 38, 44 and 48, of the presently preferred embodiment, have a right-angled triangular configuration as shown in FIG. 3, FIG. 4, FIG. 5 and FIG. 6A. It will be obvious to those skilled in the art that any of the foregoing triangular configurations or any combination thereof may be suitable for the purposes of the present invention.

Figure 3:
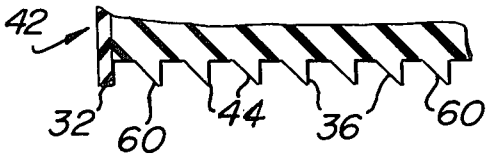
FIG. 3 is a view in cross-section of the tread design taken along 3—3 of FIG. 2.
Figure 5:
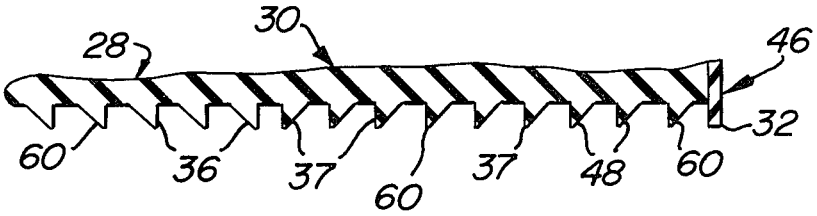
FIG. 5 is a view in cross-section of the tread design taken along 5—5 of FIG. 2.

A first set of triangularly shaped gripping members 36 is transversely disposed along the sole portion 28 of the outside half 50 of the bottom of the lower 14. The triangularly shaped gripping members of set 36 point towards the rear of the lower 14, as shown in FIG. 3 and FIG. 5. Accordingly, traction is thereby provided for forward movement.

A second set of triangularly shaped gripping members 37 is transversely disposed along the heel portion 30 of the outside half 50 of the bottom of the lower 14. The triangularly shaped gripping members of set 37 point towards the front of the lower 14, as shown in FIG. 5. The triangularly shaped gripping members of set 37, which point in the direction opposite to those triangularly shaped gripping members of set 36, provide traction for slowing down, moving backwards or resisting forward motion.

Figure 4:
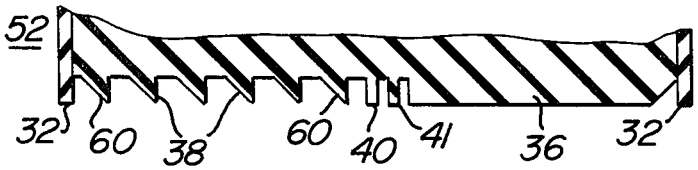
FIG. 4 is a view in cross-section of the tread design taken along 4—4 of FIG. 2.

A third set of triangularly shaped gripping members 38 is longitudinally disposed along the inside half 52 of the bottom of the lower 14. The triangularly shaped gripping members of set 38 point towards the center of the lower 14, as shown in FIG. 4. The triangularly shaped gripping members 38 on the left shoe 10 provide traction for movement to the right. The triangularly shaped gripping members 38 on the right shoe (not shown) provide traction for movement to the left.

Two rectangular, longitudinal dividing members 40 and 41 running substantially the length of the center of the bottom of the lower 14 are also shown in FIG. 4. Dividing members 40 and 41 separate the first and second sets 36 and 37 from the third set 38 of the triangularly shaped gripping members.

It may be seen that the unique disposition of four sets of triangularly shaped gripping members 36, 37, 38 (right shoe, not shown) and 38 (left shoe 10) on the bottoms of the lowers of a pair of athletic shoes in accordance with the present invention provides superior traction in all directions of movement.

A fourth set of triangularly shaped gripping members 44 may be transversely disposed at the extreme front 42 of the lower 14. The triangularly shaped gripping members of set 44 point towards the rear of the lower 14, as shown in FIG. 3. If utilized, as in the presently preferred embodiment, the triangularly shaped gripping members of set 44 provide additional traction for starting to run forward.

A fifth set of triangularly shaped gripping members 48 may be transversely disposed at the extreme rear 46 of the bottom of the lower 14. The triangularly shaped gripping members of set 48 point towards the front of the lower 14, as shown in FIG. 5. If utilized, as in the presently preferred embodiment, the triangularly shaped gripping members of set 48 provide additional traction for stopping and for beginning to move to the rear.

The present invention may be embodied in other specific forms, without departing from the spirit or essential attributes thereof, and, accordingly, reference should be made to the appended claims rather than to the foregoing specification as indicating the scope of the present invention.

I claim:

1. An athletic shoe, comprising:

a fabric upper;

padding connected to said upper, disposed inside said shoe about the ankle, back and tongue areas of said upper;

a resilient, rubber-like lower, said lower having a sole and a heel portion;

a plurality of gripping members mounted on said lower, each of said gripping members being triangularly shaped in cross-section, each of said gripping members being provided with a principal sloping face depending outwardly from said lower, said triangularly shaped gripping members pointing in the direction of the acute angle which each said principal sloping face makes with said lower;

a first set of said plurality of triangularly shaped gripping members, tranversely disposed along said sole portion of the outside half of the bottom of said lower, pointing towards the rear of said lower;

a second set of said plurality of triangularly shaped gripping members, transversely disposed along said heel portion of the outside half of the bottom of said lower, pointing towards the front of said lower;

a third set of said plurality of triangularly shaped gripping members longitudinally disposed along the inside half of the bottom of said lower, pointing towards the center of said lower; and a longitudinally dividing member running substantially the length of the bottom of said lower, separating said first and said second set of said plurality of triangularly shaped gripping members from said third set of said plurality of triangularly shaped gripping members.

2. The athletic shoe of claim 1, further comprising:

a liner attached to the inside of said upper; and said padding attached between said upper and said liner.

3. The athletic shoe of claim 1, further comprising:

a fourth set of said plurality of triangularly shaped gripping members transversely disposed in the extreme front of the bottom of said lower, pointing towards the rear of said shoe; and a fifth set of said plurality of triangularly cross-sectioned gripping members transversely disposed at the extreme rear of the bottom of said lower, pointing towards the front of the shoe.

4. The athletic shoe of claim 1, further comprising a resilient, rubber-like, reinforced toe section.

5. The athletic shoe of claim 1 wherein said padding disposed about said ankle area is substantially thicker than said padding disposed about said back area and said tongue area.

6. The athletic shoe of claim 1 wherein said padding is a flexible polyurethane foam or foam rubber.

7. The athletic shoe of claim 1 wherein said fabric is canvas and said lower is cured natural or synthetic rubber, or a polyurethane elastomer.

8. The athletic shoe of claim 1, wherein at least one of said triangular cross-sections is a right-angled triangle and said principal sloping face is the hypotenuse of said right-angled triangle.

9. The athletic shoe of claim 1, wherein at least one of said triangular cross-sections is an obtuse triangle and said principal sloping face is the longest side of said obtuse triangle.

10. The athletic shoe of claim 1, wherein at least one of said triangular cross-sections is an isosceles triangle and said principal sloping face is either of the two equal sides of said isosceles triangle.

11. The athletic shoe of claim 1, wherein at least one of said triangular cross-sections is a scalene triangle and said principal sloping face is the longer of the two sides of said scalene triangle not adjacent to said lower.

12. A pair of athletic shoes, comprising:

fabric uppers;

padding connected to said uppers, disposed inside said shoes about the ankle, back and tongue areas of said uppers;

resilient, rubber-like lowers, said lowers having heel and sole portions;

four sets of a plurality of gripping members mounted on said lowers, each of said gripping members being triangularly shaped in cross-section, each of said gripping members being provided with a principal sloping face depending outwardly from said lower, said triangularly shaped gripping members pointing in the direction of the acute angle which each of said principal sloping face makes with said lowers; and said four sets of said triangularly shaped gripping members pointing in four mutually perpendicular directions.

13. The pair of athletic shoes of claim 12, further comprising:

liners connected to the insides of said uppers; and said padding attached between said uppers and said liners.

14. The pair of athletic shoes of claim 12, wherein two of said four sets of said triangularly shaped gripping members are transversely disposed on the bottoms of said lowers and two of said four sets of said triangularly shaped gripping members are longitudinally disposed on the bottoms of said lowers.

15. The pair of athletic shoes of claim 14, wherein said two sets of transversely disposed, triangularly shaped gripping members are further disposed on the inside halves of the bottoms of said lowers and said two sets of said longitudinally disposed, triangularly shaped gripping members are further disposed on the outside halves of the bottoms of said lowers.

16. The pair of athletic shoes of claim 15, wherein said two sets of longitudinally disposed, triangularly shaped gripping members point towards the centers of said lowers.

17. The pair of athletic shoes of claim 15, further comprising longitudinal dividing members running substantially the length of the bottoms of said lowers, separating said sets of transversely disposed, triangularly shaped gripping members from said sets of longitudinally disposed, triangularly shaped gripping members, on each of said lowers.

18. The pair of athletic shoes of claim 12, wherein said padding disposed about said ankle areas is substantially thicker than said padding disposed about said back areas and said tongue areas.

19. The pair of athletic shoes of claim 12, wherein said padding is a flexible polyurethane foam or foam rubber.

20. The pair of athletic shoes of claim 12, wherein said fabric is canvas and said lower is cured natural or synthetic rubber, or a polyurethane elastomer.

21. The pair of athletic shoes of claim 12, further comprising resilient, rubber-like, reinforced toe sections.

* * * * *